US008191655B2

(12) United States Patent
Declute-Melancon

(10) Patent No.: US 8,191,655 B2
(45) Date of Patent: Jun. 5, 2012

(54) APPARATUS AND METHOD FOR REAMING A WELLBORE DURING THE INSTALLATION OF A TUBULAR STRING

(75) Inventor: Daniel Declute-Melancon, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 324 days.

(21) Appl. No.: 12/639,826

(22) Filed: Dec. 16, 2009

(65) Prior Publication Data

US 2011/0139510 A1 Jun. 16, 2011

(51) Int. Cl.
*E21B 10/44* (2006.01)

(52) U.S. Cl. ..... 175/322; 175/51; 175/323

(58) Field of Classification Search ..... 175/51, 175/57, 262, 322, 323, 403, 406
See application file for complete search history.

(56) References Cited

U.S. PATENT DOCUMENTS 1,785,086 A * 12/1930 Hauk ..... 175/317
4,452,307 A 6/1984 Horton
5,156,223 A 10/1992 Hipp
6,443,247 B1 9/2002 Wardley
6,659,173 B2 12/2003 Kirk et al.
6,983,811 B2 1/2006 Wardley
2003/0209351 A1 11/2003 Taylor et al.
2007/0267221 A1 * 11/2007 Giroux et al. ..... 175/57

FOREIGN PATENT DOCUMENTS

WO WO 2008/043985 A2 4/2008

OTHER PUBLICATIONS

International Search Report and Written Opinion, International Searching Authority—EPO (Aug. 4, 2011).
EZ Ream Casing/liner Shoe, Hughes Christensen, 2007.
BridgeBUSTER, Caledus, 2007.
Pen-o-trator, Davis-Lynch, Inc., Undated but admitted prior art.

* cited by examiner

*Primary Examiner* — Giovanna Wright
*Assistant Examiner* — Richard Alker
(74) *Attorney, Agent, or Firm* — Lawrence R. Youst

(57) ABSTRACT

An apparatus for reaming a wellbore without rotating a tubular string that is extendable to a surface. A mandrel (102) is coupled to a downhole end of the tubular string. The mandrel (102) has at least one groove (110) in a sidewall portion thereof. A sleeve (112) is operably associated with the mandrel (102) such that longitudinal travel of the mandrel (102) relative to the sleeve (112) shifts the sleeve (112) between extended and contracted positions relative to the mandrel (102). A reamer shoe (122) is coupled to a downhole end of the sleeve (112). At least one coupling device (116) is operably associated with the sleeve (112) and extendable into the at least one groove (110) such that longitudinal travel of the mandrel (102) relative to the sleeve (112) caused the sleeve (112) to rotate relative to the mandrel (102), thereby rotating the reamer shoe (122).

15 Claims, 5 Drawing Sheets

APPARATUS AND METHOD FOR REAMING A WELLBORE DURING THE INSTALLATION OF A TUBULAR STRING

FIELD OF THE INVENTION

This invention relates, in general, to equipment utilized in conjunction with operations performed in subterranean wells and, in particular, to an apparatus and method for reaming a wellbore during the installation of a tubular string without rotating the tubular string.

BACKGROUND OF THE INVENTION

Without limiting the scope of the present invention, its background is described with reference to constructing a subterranean well including a liner string, as an example.

In conventional practice, the drilling of an oil or gas well involves creating a wellbore that traverses numerous subterranean formations. For a variety reasons, each of the formations through which the well passes is preferably sealed. For example, it is important to avoid an undesirable passage of formation fluids, gases or materials out of the formation and into the wellbore or for wellbore fluids to enter the formation. In addition, it is commonly desired to isolate producing formations from nonproducing formations to avoid contaminating one formation with the fluids from another formation.

To avoid these problems, conventional well architecture includes the installation of casing within the wellbore. In addition to providing the sealing function, the casing also provides wellbore stability to counteract the geomechanics of the formation such as compaction forces, seismic forces and tectonic forces, thereby preventing the collapse of the wellbore wall. In standard practice, each succeeding casing string placed in the wellbore has an outside diameter having a reduced size when compared to the previously installed casing string. Specifically, the wellbore is drilled in intervals whereby a casing, which is to be installed in a lower wellbore interval, must be passed through the previously installed casing string in an upper wellbore interval.

The casings are generally fixed within the wellbore by a cement layer between the outer wall of the casing and the wall of the wellbore. During the drilling of the wellbore, annuli are provided between the outer surfaces of the casings and the wellbore wall. When a casing string is located in its desired position in the well, a cement slurry is pumped via the interior of the casing, around the lower end of the casing and upwards into the annulus. As soon as the annulus around the casing is sufficiently filled with the cement slurry, the cement slurry is allowed to harden. The cement sets up in the annulus, supporting and positioning the casing and forming a substantially impermeable barrier which divides the wellbore into subterranean zones.

In one approach, each casing string extends downhole from the surface such that only a lower section of each casing string is adjacent to the wellbore wall. Alternatively, the wellbore casings may include one or more liner strings, which do not extend to the surface of the wellbore, but instead typically extend from near the downhole end of a previously installed casing downward into the uncased portion of the wellbore. Liner strings are typically lowered downhole on a work string that may include a drill pipe string and a running tool that attaches to the liner string. The liner string typically includes a liner hanger at its uphole end that may be mechanically or hydraulically set.

Preferably, the liner string is set or suspended by the liner hanger at a location in the wellbore so that the downhole end of the liner string extends to close proximity of the bottom of the wellbore. It has been found, however, that in certain wellbores such as deviated wellbores, horizontal wellbores, multilateral wellbores and the like, it is difficult to work the liner string to the bottom of the wellbore. For example, during drilling of the lowermost section of the wellbore and the installation of the liner string, debris may build up near the bottom of the wellbore, which prevents installation of the liner string at the desired depth. Attempts have been made to use a conventional reamer shoe at the lower end of the liner string such that rotation of the liner string will allow the cutting structure of the reamer shoe to penetrate through the debris. It has been found, however, that in certain deep wells including the aforementioned deviated wellbores, horizontal wellbores, multilateral wellbores and the like, the torque capacity of the drilling rig, the liner threads or both, limits the ability to rotate the liner string. Accordingly, a need has arisen for an apparatus and method for reaming a wellbore during the installation of a liner string without the requirement of rotating the liner string.

SUMMARY OF THE INVENTION

The present invention disclosed herein is directed to an apparatus for reaming a wellbore during the installation of a tubular string without rotating the tubular string. More specifically, the apparatus and method of the present invention utilize a reamer shoe that does not require rotation of the tubular string during installation but instead utilizes a rotatable sleeve to rotate the reamer shoe.

In one aspect, the present invention is directed to an apparatus for reaming a wellbore without rotating the tubular string that extends to the surface of the wellbore. The apparatus includes a mandrel that is coupled to the downhole end of the tubular string. A sleeve is operably associated with the mandrel such that longitudinal travel of the mandrel relative to the sleeve rotates the sleeve relative to the mandrel. A reamer shoe is coupled to a downhole end of the sleeve such that rotation of the sleeve rotates the reamer shoe.

In one embodiment, the tubular string may be a liner string, a casing string or the like. In another embodiment, the mandrel includes at least one groove, such as a plurality of spiral grooves or a J-slot, cut in a sidewall portion of the mandrel, such as the inner or outer surface of the mandrel. In this embodiment, a coupling device that is operably associated with the sleeve and extendable into the at least one groove translates the longitudinal travel of the mandrel relative to the sleeve into rotation of the sleeve and the reamer shoe relative to the mandrel. In certain embodiments, a biasing member may be used to urge the sleeve from a contracted position toward an extended position. In this embodiment, at least one of the mandrel and the sleeve may have at least one slot in a sidewall portion thereof. In another embodiment, the reamer shoe may include a cutting structure, at least one flow port or both.

In another aspect, the present invention is directed to an apparatus for reaming a wellbore. The apparatus includes a drill pipe string extendable to the surface of the wellbore. A liner string is coupled to the downhole end of the drill pipe string. A mandrel is coupled to the downhole end of the liner string. The mandrel includes at least one groove cut in an outer surface of a sidewall portion thereof. A sleeve is at least partially position about the exterior of the mandrel such that longitudinal travel of the mandrel relative to the sleeve shifts the sleeve between an extended position and a contracted position relative to the mandrel. A reamer shoe is coupled to the downhole end of the sleeve. At least one coupling device is operably associated with the sleeve and extendable into the at least one groove such that the longitudinal travel of the mandrel relative to the sleeve caused the sleeve to rotate relative to the mandrel, thereby rotating the reamer shoe.

In another aspect, the present invention is directed to a method for reaming a wellbore. The method includes coupling a reamer assembly to a tubular string, the reamer assembly includes a mandrel, a sleeve operably associated with the mandrel and a reamer shoe coupled to the sleeve, running the tubular string into the wellbore until the reamer shoe contacts a restriction in the wellbore, applying weight on the reamer shoe via the tubular string, longitudinally contracting the reamer assembly to rotate the sleeve relative to the mandrel, thereby rotating the reamer shoe, reducing the weight applied to the reamer shoe and longitudinally extending the reamer assembly.

The method may also include coupling the reamer assembly to a liner string, a casing string or the like, sliding a coupling device operably associated with the sleeve in a groove cut in a surface of the mandrel, sliding the coupling device in the groove cut in an outer surface of the mandrel, urging the sleeve toward the extended position of the reamer assembly with a biasing member and urging the sleeve toward the extended position of the reamer assembly by pumping a fluid through at least one flow port of the reamer shoe.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the invention.

Figure 1:
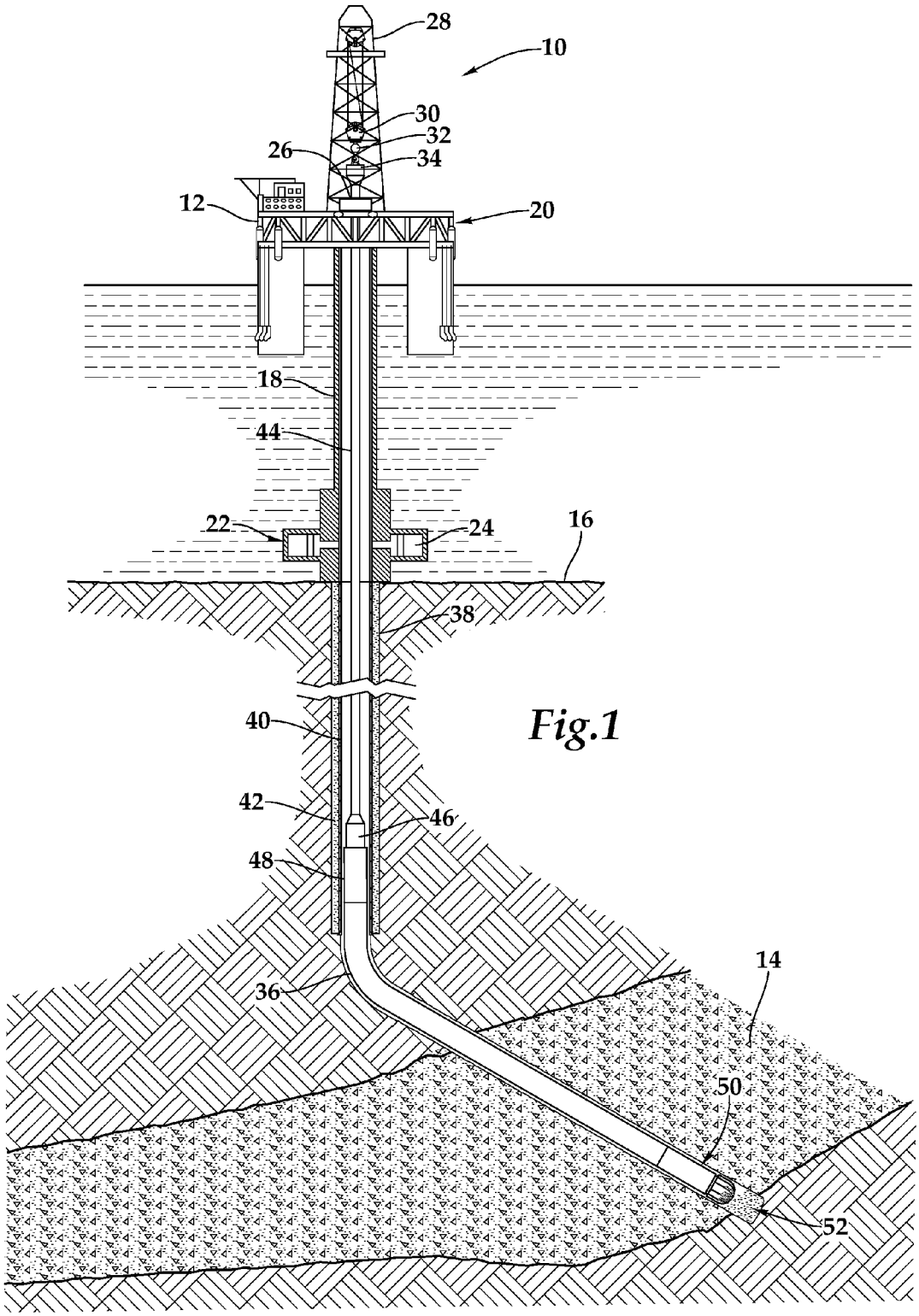
FIG. 1 is a schematic illustration of an offshore oil and gas platform operating an apparatus for reaming a wellbore according to an embodiment of the present invention.

Referring initially to FIG. 1, an apparatus for reaming a wellbore being deployed from an offshore platform is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising and lowering pipe strings, such as a liner string 36.

A wellbore 38 extends through the various earth strata including formation 14. An upper portion of wellbore 38 includes casing 40 that is cemented within wellbore 38 by cement 42. Disposed within the lower portion of wellbore 38 is liner string 36. Liner string 36 is being lowered downhole on a work string 44 that includes a setting tool 46 that attaches work string 44 to liner string 36. Preferably, the upper portion of work string 44 is formed from a drill pipe string or similar tubular members. Liner string 36 includes a liner hanger 48 at its uphole end that is operable to be set by setting tool 46.

A reamer assembly 50 is coupled to the downhole end of liner string 36. As shown, liner string 36 has been run in wellbore 38 to a position in which reamer assembly 50 has come in contact with debris 52 which has built up in the bottom of wellbore 38. This debris 52 makes it difficult to work liner string 36 to its desired location proximate the bottom of wellbore 38. Use of the present invention, however, enables liner string 36 to be positioned as desired. Specifically, reamer assembly 50 is used to clear debris 52 from the bottom of wellbore 38. Reamer assembly 50 is operated without the need to provide torque from the surface via rotating working string 44 and liner string 36. Instead, reamer assembly 50 of the present invention is rotatable responsive to the application of a compressive force applied to reamer assembly 50. This compressive force may be delivered via the application of a longitudinal force in the downhole direction from the surface via liner string 36 and work string 44 to operate reamer assembly 50 of the present invention as described in greater detail below.

Even though FIG. 1 depicts a deviated wellbore, it should be understood by those skilled in the art that the apparatus for reaming a wellbore of the present invention is equally well suited for use in wellbores having other directional orientations including vertical wellbores, horizontal wellbores, multilateral wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the uphole direction being toward the top or the left of the corresponding figure and the downhole direction being toward the bottom or the right of the corresponding figure. Also, even though FIG. 1 depicts an offshore operation, it should be understood by those skilled in the art that the apparatus for reaming a wellbore of the present invention is equally well suited for use in onshore operations.

Figure 2:
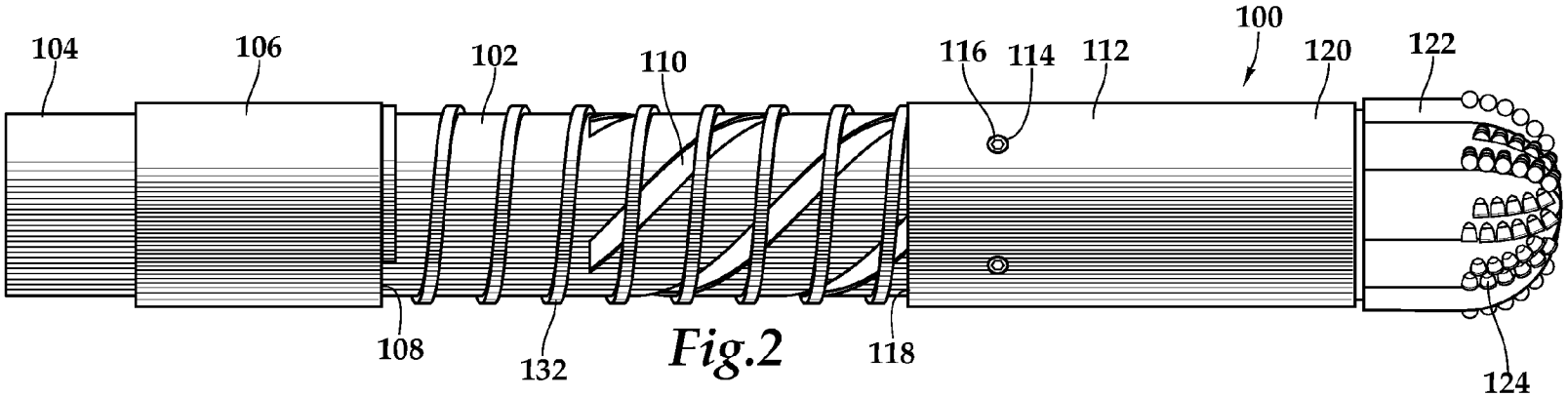
FIG. 2 is a side view of a reamer assembly in its extended configuration for use in an apparatus for reaming a wellbore according to an embodiment of the present invention.

Referring next to FIG. 2, therein is depicted a reamer assembly 100 for use in an apparatus for reaming a wellbore according to the present invention. Reamer assembly 100 is used to clear the bottom of a wellbore of debris or open a restriction encountered during the installation of a tubular string such as a casing string or liner string in a wellbore that has been previously drilled. Reamer assembly 100 includes a mandrel 102 that preferably includes a box end 104 for threadably coupling mandrel 102 with the lower end of a tubular string. In the illustrated embodiment, mandrel 102 includes a radially expanded section 106 that defines a shoulder 108. As illustrated, mandrel 102 has four spiral grooves 110 forming a plurality of turns around the outer surface of mandrel 102. Preferably, spiral grooves 110 take the form of helical curves. Even though reamer assembly 100 has be depicted as having a mandrel with four spiral grooves, it should be understood by those skilled in the art that reamer assembly 100 could alternatively have a mandrel with a greater number or lesser number of spiral grooves including a single spiral groove. In addition, even though reamer assembly 100 has be depicted as having a mandrel with spiral grooves formed in the outer surface, it should be understood by those skilled in the art that reamer assembly 100 could alternatively have a mandrel with spiral grooves formed in the inner surface.

Reamer assembly 100 includes a sleeve 112. In the illustrated embodiment, sleeve 112 is partially positioned around mandrel 102 and is sized such that mandrel 102 can move longitudinally within sleeve 112. In other embodiments, such as those embodiments in which the spiral grooves are formed in the inner surface of mandrel 102, sleeve 112 could alternative be positioned partially within mandrel 102 and sized such that mandrel 102 could move longitudinally along the exterior of sleeve 112. Sleeve 112 has a plurality of openings 114 that are preferably threaded. A pin 116 is securably received within each of the openings 114 such that pins 116 extend into spiral grooves 110 to secure sleeve 112 and mandrel 102 together. At its upper end, sleeve 112 defines a shoulder 118. Preferably, sleeve 112 has a box end 120 for threadably coupling sleeve 112 with the upper end of a reamer shoe 122. Positioned around mandrel 102 and between shoulder 108 of mandrel 102 and shoulder 118 of sleeve 112 is a biasing member depicted as a spiral wound compression spring 132 that urges sleeve 102 in the downhole direction away from radially expanded section 106 of mandrel 102. Even though a particular type of biasing member has been depicted and described, those skilled in the art will recognize that other types of biasing members, such as wave springs, spring stacks and the like could alternatively be used in conjunction with the present invention.

Figure 3:
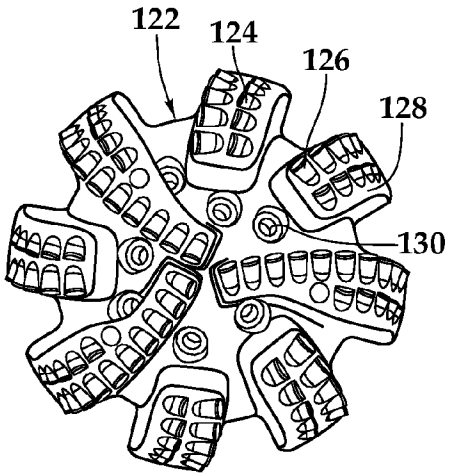
FIG. 3 is a top view of a reaming bit for use in an apparatus for reaming a wellbore according to an embodiment of the present invention.

As best seen in FIG. 3, reamer shoe 122 has a cutting structure 124 that preferably includes a plurality of inserts 126 such as tungsten carbide inserts, polycrystalline diamond compact inserts or the like. As illustrated, inserts 126 are positioned on the leading edges of a plurality of reaming blades 128 such that inserts 126 will contact not only the bottom of the wellbore or restriction in the wellbore but also the sides of the wellbore during rotation of reamer shoe 122. Reamer shoe 122 includes a plurality of flow ports that are depicted as nozzles 130. Even though a particular type of reamer shoe has been depicted and described, those skilled in the art will recognize that other types of reamer shoes having cutting structures that are operable to ream a wellbore when rotated could alternatively be used in conjunction with the present invention.

Figure 4:
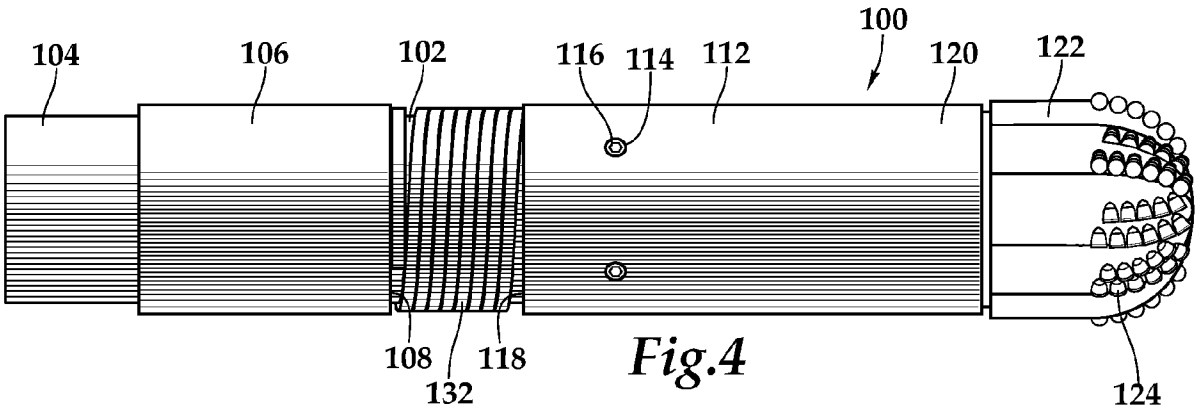
FIG. 4 is a side view of the reamer assembly of FIG. 2 in its contracted configuration.

In operation, reamer assembly 100 is coupled to the lower end of a tubular string such as a liner string, a casing string or the like and is run downhole until, for example, reamer shoe 122 contacts debris or a restriction in the wellbore. At this point, the operator can apply weight on reamer shoe 122 via the tubular string. The applied weight creates a compressive force within reamer assembly 100. The compressive force within reamer assembly 100 causes mandrel 102 to longitudinally move within sleeve 112, which contracts reamer assembly 100, as best seen in FIG. 4. Due to the pin 116 and groove 110 coupling of sleeve 112 and mandrel 102, this longitudinal movement of mandrel 102 relative to sleeve 112 causes sleeve 112 to rotate relative to mandrel 102. As reamer shoe 122 is securably coupled to sleeve 112, this rotation of sleeve 112 causes reamer shoe 122 to rotate, thereby reaming the wellbore. Preferably, fluid is circulated from the surface through the tubular string and reamer assembly 100 such that the fluid is injected out of reamer shoe 122 via nozzles 130. The fluid then carries the cutting to the surface by traveling up through the annulus surrounding the tubular string.

The process of rotating reamer shoe 122 can be repeated as necessary such that the tubular string may be positioned in the wellbore as desired. Specifically, by slacking off on the weight being applied to reamer shoe 122, the tensile force generated by spring 132 as well as the downhole force generated by the pressure drop of fluids travel through nozzles 130, during pumping operations, will urge sleeve 112 to travel longitudinally relative to mandrel 102 and return reamer assembly 100 to the position depicted in FIG. 2. Thereafter, repeated cycles of weight on reamer shoe 122 will rotate reamer shoe 122 as required.

Figure 5:
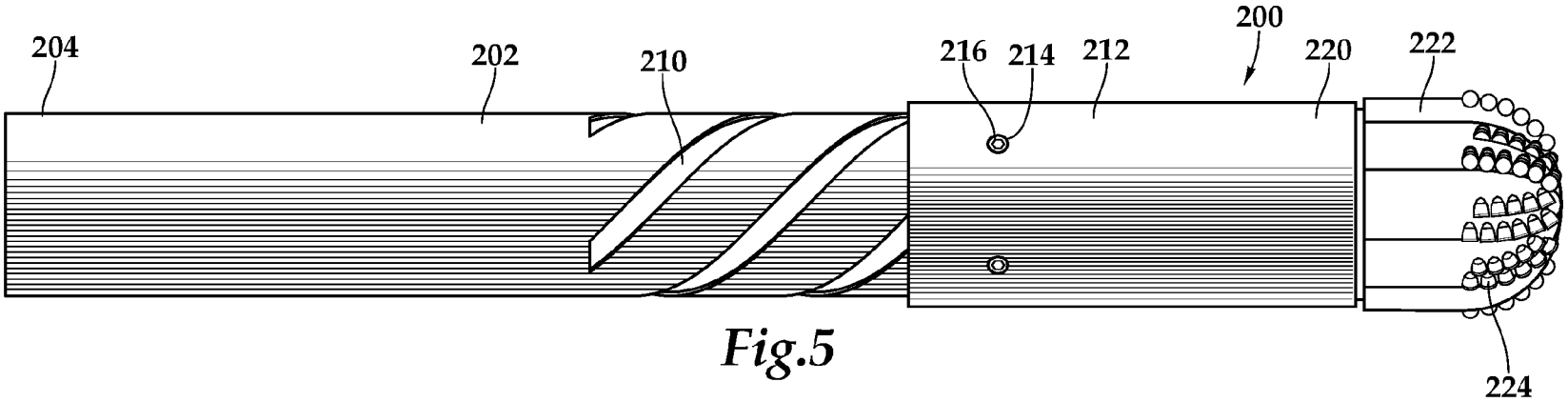
FIG. 5 is a side view of a reamer assembly for use in an apparatus for reaming a wellbore according to an embodiment of the present invention.

Referring next to FIG. 5, therein is depicted a reamer assembly 200 for use in an apparatus for reaming a wellbore according to the present invention. Reamer assembly 200 includes a mandrel 202 that preferably includes a box end 204 for threadably coupling mandrel 202 with the lower end of a tubular string. As illustrated, mandrel 202 has four spiral grooves 210 forming a plurality of turns around the outer surface of mandrel 202. Reamer assembly 200 includes a sleeve 212. In the illustrated embodiment, sleeve 212 is partially positioned around mandrel 202 and is sized such that mandrel 202 can move longitudinally within sleeve 212. Sleeve 212 has a plurality of openings 214 that are preferably threaded. A pin 216 is securably received within each of the openings 214 such that pins 216 extend into spiral grooves 210 to secure sleeve 212 and mandrel 202 together. Preferably, sleeve 212 has a box end 220 for threadably coupling sleeve 212 with the upper end of a reamer shoe 222 that includes a cutting structure 224 and a plurality of flow ports (not pictured).

In operation, reamer assembly 200 is coupled to the lower end of a tubular string and is run downhole until, for example, reamer shoe 222 contacts debris or a restriction in the wellbore. At this point, the operator can apply weight on reamer shoe 222 via the tubular string. The applied weight creates a compressive force within reamer assembly 200. The compressive force within reamer assembly 200 causes mandrel 202 to longitudinally move within sleeve 212, which contracts reamer assembly 200. Due to the pin 216 and groove 210 coupling of sleeve 212 and mandrel 202, this longitudinal movement of mandrel 202 relative to sleeve 212 causes sleeve 212 and reamer shoe 222 to rotate relative to mandrel 202, thereby reaming the wellbore. A fluid is circulated from the surface through the tubular string and reamer assembly 200 such that the fluid is injected out of reamer shoe 222 via the nozzles to carry cutting to the surface. The process of rotating reamer shoe 222 can be repeated as necessary by slacking off on the weight being applied to reamer shoe 222 which allows the downhole force generated by the pressure drop of fluids travel through the nozzles to extend sleeve 212 relative to mandrel 202.

Figure 6:
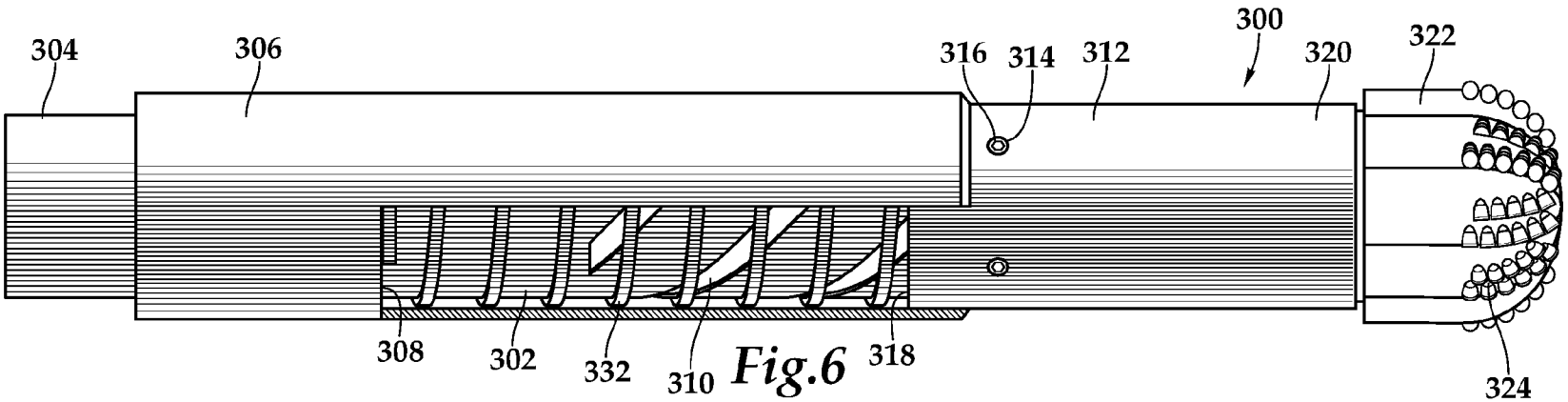
FIG. 6 is a side view, partially cut away, of a reamer assembly for use in an apparatus for reaming a wellbore according to an embodiment of the present invention.

Referring next to FIG. 6, therein is depicted a reamer assembly 300 for use in an apparatus for reaming a wellbore according to the present invention. Reamer assembly 300 includes a mandrel 302 that preferably includes a box end 304 for threadably coupling mandrel 302 with the lower end of a tubular string. As illustrated, mandrel 302 has four spiral grooves 310 forming a plurality of turns around the outer surface of mandrel 302. Reamer assembly 300 includes an outer shroud 306 that is securably coupled to or integral with mandrel 302. Outer shroud 306 includes a shoulder 308. Reamer assembly 300 also includes a sleeve 312. In the illustrated embodiment, sleeve 312 is partially positioned around mandrel 302 and is sized such that mandrel 302 can move longitudinally within sleeve 312. Sleeve 212 has a plurality of openings 314 that are preferably threaded. A pin 316 is securably received within each of the openings 314 such that pins 316 extend into spiral grooves 310 to secure sleeve 312 and mandrel 302 together. Preferably, sleeve 312 has a box end 320 for threadably coupling sleeve 312 with the upper end of a reamer shoe 322 that includes a cutting structure 324 and a plurality of flow ports (not pictured). Sleeve 312 includes a shoulder 318. A spring 332 is positioned around mandrel 302, between shoulder 308 and shoulder 318. Shroud 306 protects spring 332 from damage during installation and operation of reamer assembly 300. Reamer assembly 300 operates substantially similar to reamer assembly 100 described above.

Figure 7:
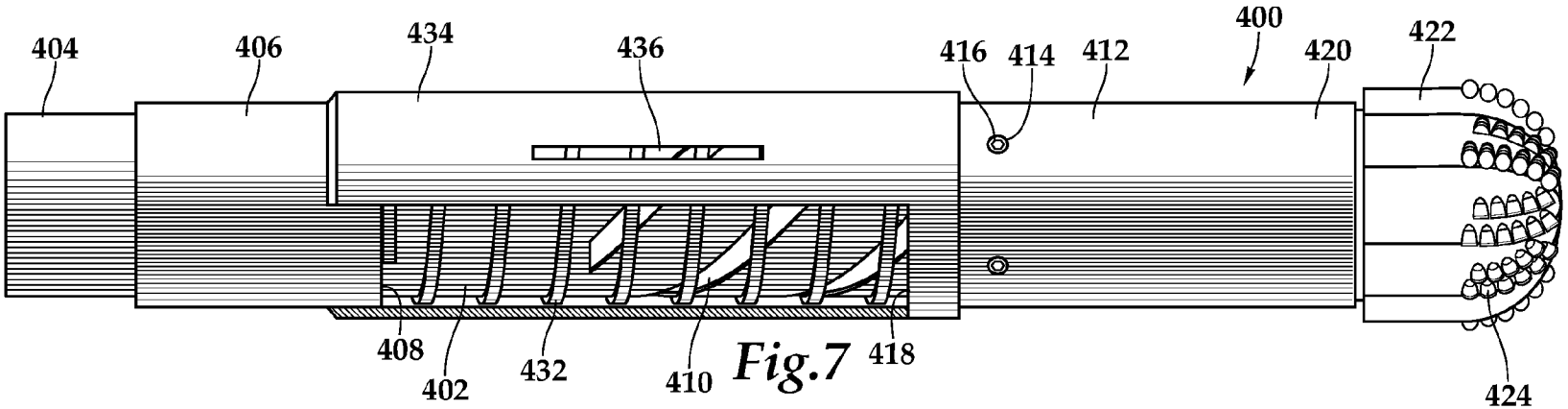
FIG. 7 is a side view, partially cut away, of a reamer assembly for use in an apparatus for reaming a wellbore according to an embodiment of the present invention.

Referring next to FIG. 7, therein is depicted a reamer assembly 400 for use in an apparatus for reaming a wellbore according to the present invention. Reamer assembly 400 includes a mandrel 402 that preferably includes a box end 404 for threadably coupling mandrel 402 with the lower end of a tubular string. As illustrated, mandrel 402 has four spiral grooves 410 forming a plurality of turns around the outer surface of mandrel 402. Mandrel 402 includes a radially expanded section 406 that defines a shoulder 408. Reamer assembly 400 includes a sleeve 412. In the illustrated embodiment, sleeve 412 is partially positioned around mandrel 402 and is sized such that mandrel 402 can move longitudinally within sleeve 412. Sleeve 412 has a plurality of openings 414 that are preferably threaded. A pin 416 is securably received within each of the openings 414 such that pins 416 extend into spiral grooves 410 to secure sleeve 412 and mandrel 402 together. Preferably, sleeve 412 has a box end 420 for threadably coupling sleeve 412 with the upper end of a reamer shoe 422 that includes a cutting structure 424 and a plurality of flow ports (not pictured). Sleeve 412 includes a shoulder 418. A spring 432 is positioned around mandrel 402, between shoulder 408 and shoulder 418. Reamer assembly 400 includes an outer shroud 434 that is securably coupled to or integral with sleeve 412. Shroud 434 includes one or more slots 436. Shroud 434 protects spring 432 from damage during installation and operation of reamer assembly 400 and slots 436 allow fluid to flow around spring 432 to keep this area free from debris. Reamer assembly 400 operates substantially similar to reamer assembly 100 described above.

Figure 8:
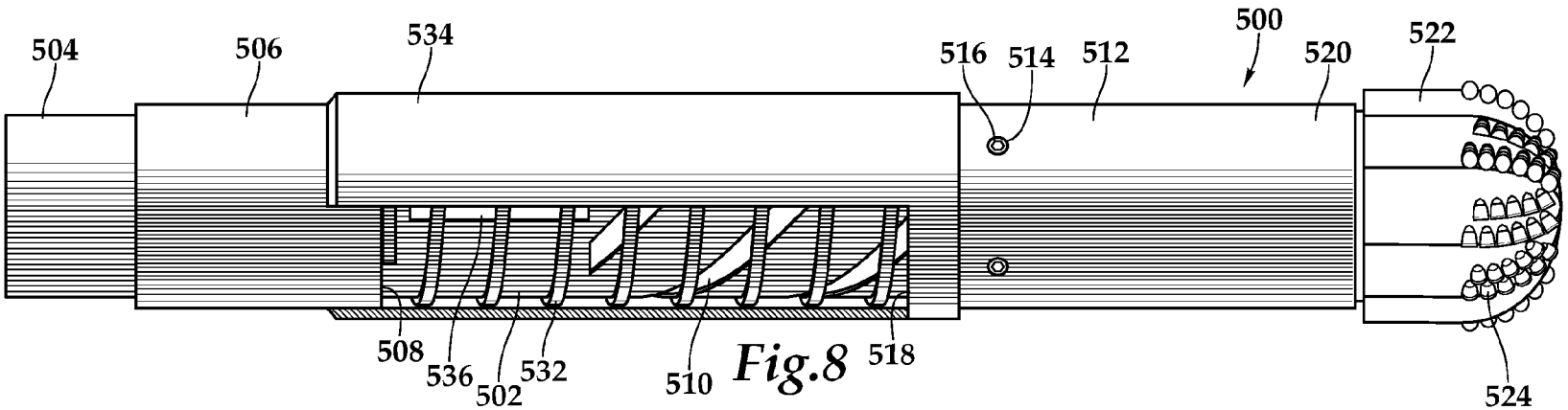
FIG. 8 is a side view, partially cut away, of a reamer assembly for use in an apparatus for reaming a wellbore according to an embodiment of the present invention.

Referring next to FIG. 8, therein is depicted a reamer assembly 500 for use in an apparatus for reaming a wellbore according to the present invention. Reamer assembly 500 includes a mandrel 502 that preferably includes a box end 504 for threadably coupling mandrel 502 with the lower end of a tubular string. Mandrel 502 includes a radially expanded section 506 that defines a shoulder 508. As illustrated, mandrel 502 has four spiral grooves 510 forming a plurality of turns around the outer surface of mandrel 502. Mandrel 502 has one or more slots 536. Reamer assembly 500 includes a sleeve 512. In the illustrated embodiment, sleeve 512 is partially positioned around mandrel 502 and is sized such that mandrel 502 can move longitudinally within sleeve 512. Sleeve 512 has a plurality of openings 514 that are preferably threaded. A pin 516 is securably received within each of the openings 514 such that pins 516 extend into spiral grooves 510 to secure sleeve 512 and mandrel 502 together. Preferably, sleeve 512 has a box end 520 for threadably coupling sleeve 512 with the upper end of a reamer shoe 522 that includes a cutting structure 524 and a plurality of flow ports (not pictured). Sleeve 512 includes a shoulder 518. A spring 532 is positioned around mandrel 502, between shoulder 508 and shoulder 518. Reamer assembly 500 includes an outer shroud 534 that is securably coupled to or integral with sleeve 512. Shroud 534 protects spring 532 from damage during installation and operation of reamer assembly 500 and slots 536 of mandrel 502 allow fluid to flow around spring 532 to keep this area free from debris. Reamer assembly 500 operates substantially similar to reamer assembly 100 described above.

Figure 9:
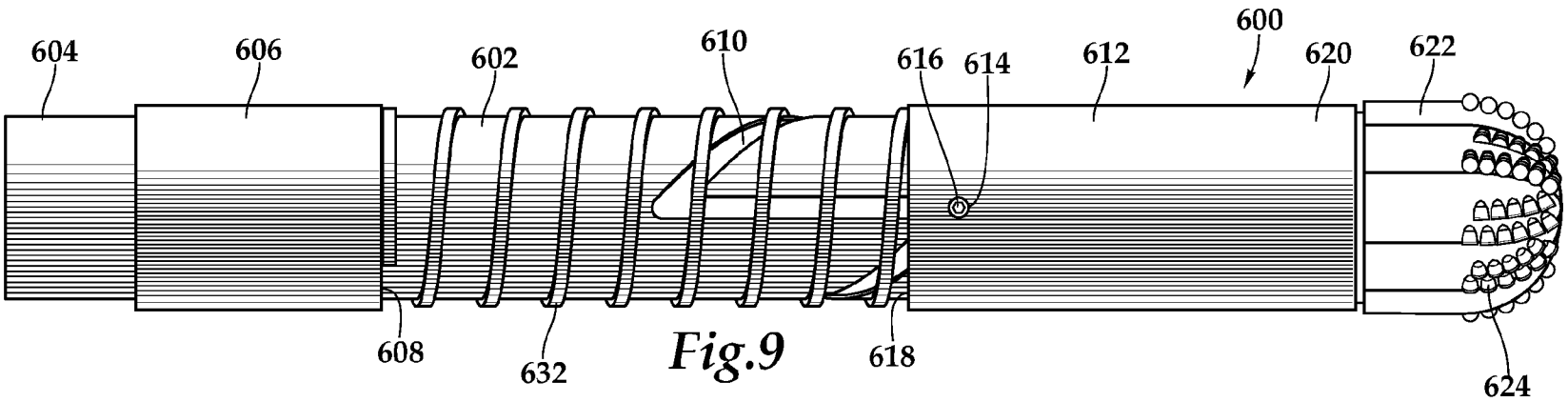
FIG. 9 is a side view of a reamer assembly for use in an apparatus for reaming a wellbore according to an embodiment of the present invention.

Referring next to FIG. 9, therein is depicted a reamer assembly 600 for use in an apparatus for reaming a wellbore according to the present invention. Reamer assembly 600 includes a mandrel 602 that preferably includes a box end 604 for threadably coupling mandrel 602 with the lower end of a tubular string. Mandrel 602 includes a radially expanded section 606 that defines a shoulder 608. As illustrated, mandrel 602 has a single continuous groove depicted as a J-slot 610 forming a plurality of turns around the outer surface of mandrel 602. Reamer assembly 600 includes a sleeve 612. In the illustrated embodiment, sleeve 612 is partially positioned around mandrel 602 and is sized such that mandrel 602 can move longitudinally within sleeve 612. Sleeve 612 has a plurality of openings 614 that are preferably threaded. A pin 616 is securably received within each of the openings 614 such that pins 616 extend into J-slot 610 to secure sleeve 612 and mandrel 602 together. Preferably, sleeve 612 has a box end 620 for threadably coupling sleeve 612 with the upper end of a reamer shoe 622 that includes a cutting structure 624 and a plurality of flow ports (not pictured). Sleeve 612 includes a shoulder 618. A spring 632 is positioned around mandrel 602, between shoulder 608 and shoulder 618. Reamer assembly 600 operates substantially similar to reamer assembly 100 described above except that sleeve 612 and therefore reamer shoe 622 rotate to the right as reamer assembly 600 is compressed but do not counter rotate on the reverse stroke as pins 616 travel in the longitudinal portions of J-slot 610.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. An apparatus for reaming a wellbore, the apparatus comprising:

a tubular string extendable to a surface of the wellbore;

a mandrel coupled to a downhole end of the tubular string, the mandrel including at least one groove in a sidewall portion thereof;

a sleeve at least partially positioned about the exterior of the mandrel such that longitudinal travel of the mandrel in at least a first direction relative to the sleeve rotates the sleeve relative to the mandrel;

a reamer shoe coupled to a downhole end of the sleeve such that rotation of the sleeve rotates the reamer shoe; and at least one coupling device operably associated with the sleeve and extendable into the at least one groove such that the longitudinal travel of the mandrel relative to the sleeve causes the coupling device to slide within the groove;

wherein weight applied to the reamer shoe from the tubular string shifts the mandrel in the first longitudinal direction relative to the sleeve, thereby rotating the reamer shoe; and wherein fluid pressure applied to the reamer shoe from the tubular string longitudinally urges the mandrel in a second longitudinal direction relative to the sleeve.

2. The apparatus as recited in claim 1 wherein the tubular string further comprises at least one of a liner string and a casing string.

3. The apparatus as recited in claim 1 further comprising a biasing member that urges the sleeve in a downhole direction relative to the mandrel.

4. The apparatus as recited in claim 3 wherein at least one of the mandrel and the sleeve has at least one slot in a sidewall portion thereof.

5. The apparatus as recited in claim 1 wherein the reamer shoe further comprises a cutting structure.

6. The apparatus as recited in claim 1 wherein the reamer shoe further comprises at least one flow port.

7. An apparatus for reaming a wellbore, the apparatus comprising:

a drill pipe string extendable to a surface of the wellbore;

a liner string coupled to a downhole end of the drill pipe string;

a mandrel coupled to a downhole end of the liner string, the mandrel including at least one groove cut in an outer surface of a sidewall portion thereof;

a sleeve at least partially positioned about the exterior of the mandrel such that longitudinal travel of the mandrel relative to the sleeve shifts the sleeve between an extended position and a contracted position relative to the mandrel;

a reamer shoe coupled to a downhole end of the sleeve; and at least one coupling device operably associated with the sleeve and extendable into the at least one groove such that the longitudinal travel of the mandrel in at least a first direction relative to the sleeve causes the sleeve to rotate relative to the mandrel, thereby rotating the reamer shoe;

wherein weight applied to the reamer shoe from the drill pipe shifts the mandrel in the first longitudinal direction relative to the sleeve toward the contracted position, thereby rotating the reamer shoe; and wherein fluid pressure applied to the reamer shoe from the drill pipe longitudinally urges the mandrel in a second longitudinal direction relative to the sleeve toward the extended position.

8. The apparatus as recited in claim 7 further comprising a biasing member that urges the sleeve from the contracted position toward the extended position.

9. The apparatus as recited in claim 7 wherein at least one of the mandrel and the sleeve has at least one slot in a sidewall portion thereof.

10. The apparatus as recited in claim 7 wherein the reamer shoe further comprises a cutting structure.

11. The apparatus as recited in claim 7 wherein the reamer shoe further comprises at least one flow port.

12. A method for reaming a wellbore, the method comprising:

coupling a reamer assembly to a tubular string, the reamer assembly including a mandrel having at least one groove in a sidewall portion thereof, a sleeve at least partially positioned about the exterior of the mandrel, at least one coupling device operably associated with the sleeve and extendable into the at least one groove and a reamer shoe coupled to the sleeve;

running the tubular string into the wellbore until the reamer shoe contacts a restriction in the wellbore;

applying weight on the reamer shoe via the tubular string;

longitudinally contracting the reamer assembly by longitudinally shifting the mandrel relative to the sleeve and sliding the coupling device within the groove to rotate the sleeve relative to the mandrel, thereby rotating the reamer shoe;

reducing the weight applied to the reamer shoe;

urging the sleeve in the downhole direction by pumping a fluid through at least one flow port of the reamer shoe; and longitudinally extending the reamer assembly.

13. The method as recited in claim 12 wherein coupling the reamer assembly to the tubular string further comprises coupling the reamer assembly to a liner string.

14. The method as recited in claim 12 wherein coupling the reamer assembly to the tubular string further comprises coupling the reamer assembly to a casing string.

15. The method as recited in claim 12 wherein longitudinally extending the reamer assembly further comprises urging the sleeve in the downhole direction with a biasing member.

* * * * *